US006547949B1

(12) United States Patent
Anastasijevic et al.

(10) Patent No.: US 6,547,949 B1
(45) Date of Patent: Apr. 15, 2003

(54) METHOD FOR PREVENTING STRAY CURRENTS IN PERIPHERAL SYSTEM PARTS DURING AN ELECTROLYSIS PROCESS FOR OBTAINING METALS

(75) Inventors: Nikola Anastasijevic, Altenstadt (DE); Stefan Laibach, Geismar/Röhn (DE); Friedhelm Münker, Offenbach (DE); Markus Schweitzer, Runkel-Hofen (DE); Walter Kühn, Laudenbach (DE)

(73) Assignee: MG Technologies AG, Frankfurt am Main (DE)

( * ) Notice: Subject to any disclaimer, the term of this patent is extended or adjusted under 35 U.S.C. 154(b) by 0 days.

(21) Appl. No.: 09/936,392

(22) PCT Filed: May 19, 2000

(86) PCT No.: PCT/EP00/04524

§ 371 (c)(1),
(2), (4) Date: Sep. 10, 2001

(87) PCT Pub. No.: WO01/16401

PCT Pub. Date: Mar. 8, 2001

(51) Int. Cl.[7] ..... C25C 7/06

(52) U.S. Cl. ..... 205/560; 205/574; 205/584; 205/587; 205/602; 205/724; 205/740; 205/771

(58) Field of Search ..... 205/560, 584, 205/574, 587, 602, 724, 740, 771

(56) References Cited

U.S. PATENT DOCUMENTS 4,285,794 A 8/1981 Bellows et al.
5,876,575 A * 3/1999 Kump ..... 204/197
6,261,439 B1 * 7/2001 Schwabe et al. ..... 205/725

FOREIGN PATENT DOCUMENTS

JP 62 170491 7/1987
SU 700 565 11/1979

* cited by examiner

*Primary Examiner*—Arun S. Phasge
(74) *Attorney, Agent, or Firm*—Herbert Dubno

(57) ABSTRACT

The electrolyte is supplied from a reservoir through at least one supply line to an electrolysis area including anodes and cathodes and at least one electric d.c. voltage source, and used electrolyte is at least partly recirculated from the electrolysis area back to the reservoir through at least one discharge line. Between a first contact point in the electrolyte of the supply line and a second contact point in the electrolyte of the discharge line there is a bridge line containing electrolyte, where the ohmic resistance R1 of the electrolyte in the bridge line between the first and the second contact point is not more than 10% of the ohmic resistance R2 which exists between the first and the second contact point in the electrolyte flowing through the reservoir. The amount of electrolyte flowing through the bridge line per unit time is not more than 5% of the amount of electrolyte flowing in the supply line in the vicinity of the first contact point.

5 Claims, 1 Drawing Sheet

METHOD FOR PREVENTING STRAY CURRENTS IN PERIPHERAL SYSTEM PARTS DURING AN ELECTROLYSIS PROCESS FOR OBTAINING METALS

DESCRIPTION

This invention relates to a process for the electrolytic recovery of a metal which is ionogenically contained in an electrolyte, wherein the electrolyte is supplied from a reservoir through at least one supply line to an electrolysis area including anodes and cathodes and at least one d.c. voltage source, and wherein used electrolyte is at least partly recirculated from the electrolysis area to the reservoir through at least one discharge line.

In electrolysis plants of this kind a so-called stray current usually flows through the supply line and the discharge line, which stray current leads to corrosion problems in the peripheral parts of the plant, e.g. in the reservoir, in the electrolyte conditioning and in a usually present electrolyte preheater. Would the supply line and/or the discharge line be grounded, metal deposits would occur in the line in the vicinity of the ground terminal. If one tried to solve these problems by current interruption, this would involve quite considerable costs.

It is the object underlying the invention to make the current flowing through the supply line and the discharge line ineffective in a simple and reliable way, so that even with relatively high electric voltages in the electrolysis area stray currents in the peripheral parts of the plant outside the electrolysis area are effectively avoided. In accordance with the invention this is achieved in the above-mentioned process in that between a first contact point in the electrolyte of the supply line and a second contact point in the electrolyte of the discharge line a bridge line containing electrolyte is provided, where the ohmic resistance R1 of the electrolyte in the bridge line between the first and the second contact point is not more than 10% of the ohmic resistance R2, which exists between the first and the second contact point in the electrolyte flowing through the reservoir, and that the amount of electrolyte flowing through the bridge line per unit time is not more than 5% of the amount of electrolyte flowing in the supply line in the vicinity of the first contact point.

Usually, the difference of the electric voltage in the electrolysis area between the supply line and the discharge line is at least 20 Volt, it may be lower but in particular also much higher. The problem of the stray currents increases with increasing voltage difference, and in the present case the bridge line provided is advantageous in particular when the voltage difference in the electrolysis area between the supply line and the discharge line is 100–800 Volt.

It should expediently be ensured that the ohmic resistance of the electrolyte flow in the supply line between the first contact point and the electrolysis area as well as between the second contact point and the electrolysis area is each at least 5 times and preferably at least 20 times the amount of R2. This can for instance be achieved in that the length of the line between the first or the second contact point and the electrolysis area is several meters and in particular 10 to 100 m.

It is ensured that the ohmic resistance of the electrolyte in the bridge line is as small as possible, so that the bridge line between the supply line and the discharge line wholly or nearly acts like an electric short circuit. At the same time it is important that the flow of electrolyte through the bridge line is small and possibly prevented at all. For this purpose, one or more flow obstacles are for instance incorporated in the bridge line, but at the same time a continuous electrolytic wetting exists. For the flow obstacle there may for instance be used a bed of isolating granules, e.g. ceramic or plastic beads, nets, a knitted fabric, a sponge-like plug, a diaphragm or an ion exchanger membrane, in particular an anion exchanger membrane. Furthermore, a control valve may be provided in the bridge line, by means of which control valve the desired small electrolyte flow rate can be adjusted.

The electrolysis may serve the recovery of copper, nickel, zinc or cobalt, where the electrolyte solutions known per se are employed. Details of the configuration of an electrolysis used for metal recovery are known and described for instance in Ullmann's Encyclopedia of Industrial Chemistry, 5th edition, vol. A9, pp. 197–217.

Embodiments of the process will be explained by means of the drawing, wherein.

Figure 1:
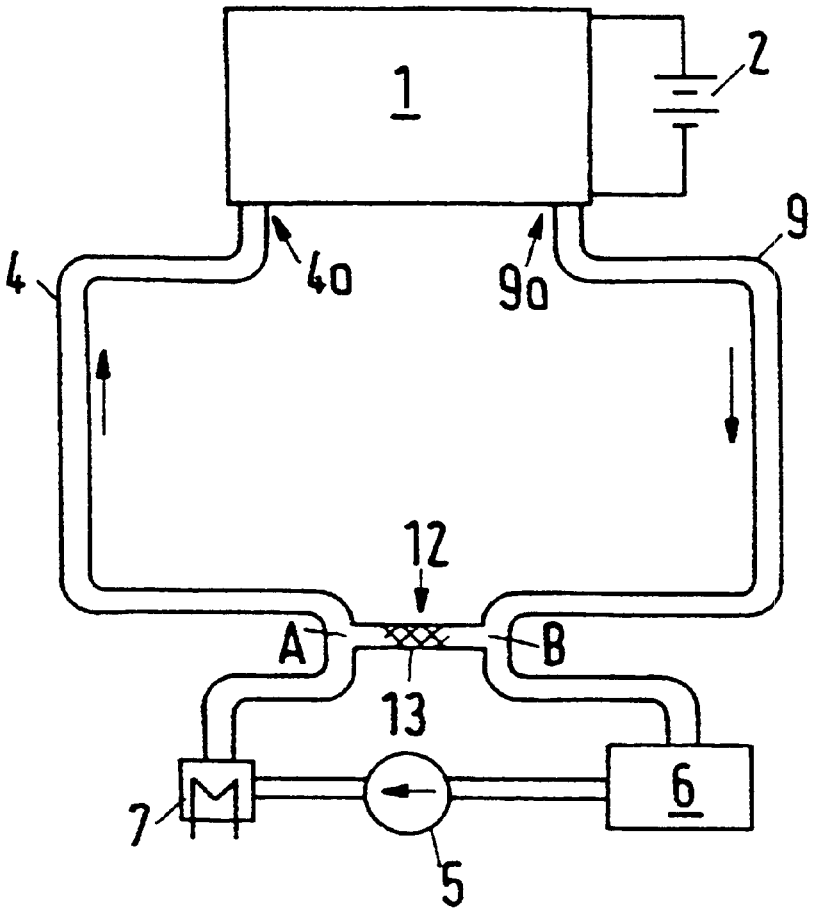
FIG. 1 shows a flow diagram of the process.

In accordance with FIG. 1, the electrolysis area 1 has a d.c. voltage source 2 which in a manner known per se provides the necessary voltage between the cathodes and anodes. The electrolysis area 1 is represented only schematically in FIG. 1 and in practice may consist of many electrolyte tanks connected in series with numerous plate-shaped electrodes suspended therein.

Fresh electrolyte is supplied through the supply line 4 into the electrolysis area 1, which electrolyte comes from the reservoir 6 and is first of all passed through a preheater 7 by means of the circulating pump 5. At the inlet point 4*a*, the electrolyte flows into the electrolysis area 1.

Used electrolyte is withdrawn from the outlet point 9*a* through the discharge line 9 and at least partly recirculated to the reservoir 6. The reservoir is connected with an electrolyte processing not represented, which also supplies fresh electrolyte to the reservoir. The voltage supply of the electrolysis only partly influences the peripheral parts of the plant.

Due to the electrical conductivity of the electrolyte the voltage source 2 produces a current which flows through the supply line 4 and the discharge line 9 and energizes all parts of the plant connected with these lines. To prevent that this so-called stray current has a disturbing influence on the reservoir 6 and the preheater 7 and possibly on other peripheral parts of the plant and in particular leads to corrosion, the supply line and the discharge line are electrically connected by the bridge line 12. Between a first contact point A in the electrolyte of the supply line and a second contact point B in the electrolyte of the discharge line an electrically conductive connection is provided by the bridge line 12. To wholly or largely prevent the flow of electrolyte through the bridge line 12, a flow obstacle 13 is provided in the bridge line 12, which flow obstacle hardly or not at all impedes the flow of the electric current. Thereby, the bridge line with the electrolyte contained therein wholly or nearly acts like an electric short circuit, which keeps the stray current through the electrolyte away from the area of the reservoir 6 and the preheater 7. The stray current, which flows for instance through the preheater 7, usually is not more than 10% of the current flowing through the bridge line 12. It is very well possible that currents of 10 to 50 A must be expected, which flow through the bridge line 12.

Figure 2:
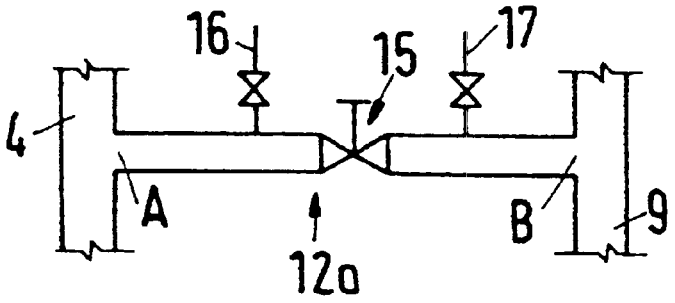
FIG. 2 shows a variant of the bridge line in a schematic representation.

The bridge line 12*a* of FIG. 2, which connects the supply line 4 with the discharge line 9, has a control valve 15 and is provided with lockable vent lines 16 and 17. The control valve serves the desired adjustment of the flow of electrolyte through the bridge line 12*a*.

EXAMPLE 1

(Comparative Example)

In the arrangement as shown in FIG. 1 the bridge line 12 is omitted. The used electrolyte serves the recovery of copper, it has a temperature in line 4 of 50° C. and a specific conductivity (conductance) of 556.5 mS/cm. 260 $m^3$/h electrolyte flow through lines 4 and 9. The voltage difference between the points 4*a* and 9*a* is 144 V against ground, an electric current of 3 A flows through lines 4 and 9 and also through the peripheral parts of the plant, where it may lead to corrosion. The entire resistance of lines 4 and 9 and of the peripheral parts of the plant between the points 4*a* and 9*a* is 47.5 Ohm, of which 0,025 Ohm exist on line 4 between the point 4*a* and the outlet of the preheater 7 with a line length of 10 m.

EXAMPLE 2

The arrangement as shown in FIG. 1 is operated as in Example 1, but is now provided with a bridge line 12*a* as it is represented in FIG. 2. The ohmic resistance of the electrolyte in the bridge line is 0.1 Ohm. The voltage difference which in the electrolyte circuit lies outside the electrolysis arrangement 1 between the points 4*a* and 9*a* is reduced to 2.8 V by the almost short circuit, a current of 27.34 V flows through the bridge line 12 and a residual current of 0.06 A e.g. through the preheater 7. The relatively high current of 27.4 A flowing through lines 4 and 9 increases the energy consumption as compared to Example 1, but prevents corrosions in the vicinity of the peripheral parts of the plant (5) to (7).

What is claimed is:

1. A process for the electrolytic recovery of a metal which is ionogenically contained in an electrolyte, wherein the electrolyte is supplied from a reservoir through at least one supply line to an electrolysis area including anodes and cathodes and at least one d.c. voltage source, and wherein used electrolyte is at least partly recirculated from the electrolysis area to the reservoir through at least one discharge line, characterized in that between a first contact point in the electrolyte of the supply line and a second contact point in the electrolyte of the discharge line a bridge line containing electrolyte is provided, where the ohmic resistance R1 of the electrolyte in the bridge line between the first and the second contact point is not more than 10% of the ohmic resistance R2, which exists between the first and the second contact point in the electrolyte flowing through the reservoir, and that the amount of electrolyte flowing through the bridge line per unit time is not more than 5% of the amount of electrolyte flowing in the supply line in the vicinity of the first contact point.

2. The process as claimed in claim 1, characterized in that the ohmic resistance of the flow of electrolyte in the supply line between the first contact point and the electrolysis area is at least 5 times the amount of R2.

3. The process as claimed in claim 1, characterized in that the ohmic resistance of the flow of electrolyte in the discharge line between the electrolysis area and the second contact point is at least 5 times the amount of R2.

4. The process as claimed in claim 1, characterized in that the difference of the electric voltage in the electrolysis area between the supply line and the discharge line is at least 20 Volt.

5. The process as claimed in claim 1, characterized in that the bridge line has a variable cross-section for the flow of electrolyte.

* * * * *